United States Patent [19]

McCree

[11] Patent Number: 4,854,637

[45] Date of Patent: Aug. 8, 1989

[54] SEAT CUSHION BACK PACK

[76] Inventor: LaVan McCree, 3172 Marathon Dr., San Diego, Calif. 92123

[21] Appl. No.: 118,536

[22] Filed: Nov. 9, 1987

[51] Int. Cl.[4] ..... A47C 9/10

[52] U.S. Cl. ..... 297/188; 297/217

[58] Field of Search ..... 297/4, 252, 219, 229, 297/188, 217; 224/151; 383/38, 39, 40; 150/117; 190/109, 111

[56] References Cited

U.S. PATENT DOCUMENTS

| | | | |
|---|---|---|---|
| 2,316,328 | 4/1943 | Guenther et al. | 190/109 X |
| 2,404,109 | 7/1946 | Steele | 297/188 |
| 2,582,447 | 1/1952 | Meyers | 150/117 |
| 2,664,939 | 1/1954 | Besch | 297/4 |
| 2,691,400 | 10/1954 | Giordano | 190/111 |
| 2,865,433 | 12/1958 | Warner | 297/188 |
| 3,580,633 | 5/1971 | DuPriest | 297/188 X |
| 3,955,609 | 5/1976 | Siegel | 150/117 |
| 4,086,945 | 5/1978 | Carter | 190/109 X |
| 4,387,924 | 6/1983 | Fernandez | 297/188 |

*Primary Examiner*—Peter A. Aschenbrenner
*Attorney, Agent, or Firm*—Baker, Maxham Jester & Meador

[57] ABSTRACT

A seat cushion back pack especially adapted for use when going to and from and attending sporting events. The apparatus is formed with flaps having a plurality of pockets therein. The pocket openings are oriented upwardly when the apparatus is in either the back pack or the seat cushion configuration. Further pocket means is provided in an alternative embodiment for retaining a blanket. The apparatus also includes strap means for carrying it as a back pack.

9 Claims, 1 Drawing Sheet

SEAT CUSHION BACK PACK

FIELD OF THE INVENTION

This invention relates generally to seat cushions and means for carrying items to sporting events and more particularly concerns a seat cushion with flexibility connected flaps having pockets therein, the combination being configured as a back pack or as a seat cushion with the flaps with the pockets therein hanging downwardly and being readily accessible.

BACKGROUND OF THE INVENTION

It is common for people attending sporting events to carry with them a seat pad or cushion, a blanket in colder climates, and possibly a satchel or a back pack for retaining food, programs, wallets, sun protection lotion, glasses, binoculars, cameras or other miscellaneous items. Many times people leave the binoculars or glasses or other items behind either when leaving home to go to or upon leaving the event because there are so many items or they are cumbersome to carry or both. Even if they are all carried into the stadium, keeping track of them safely and handling them during the course of an event such as a sporting event can be at the least an inconvenience and even a problem. Another significant problem is when liquid is spilled by adjacent patrons so that the items stored under the seat may be damaged by the liquid. It is also possible that they may be stopped on or kicked by the person who carries them to the stadium or by others passing by the person's seat.

SUMMARY OF THE INVENTION

It is an object of this invention to provide in convenient form a seat cushion with means for carrying sundry items including programs, food, wallets, binoculars, cameras, glasses, suntan lotion and other items to a public event in a manner whereby they are readily accessible, are easily carried, are not in the way, are not subject to damage by spilled liquid or to being left behind when the event is completed.

The device of this invention comprises a padded portion from which hangs one or more flaps having one or more pockets therein. Straps are provided on the device so that it can be carried compactly as a back pack. Alternatively the device functions as a cushion for the stadium seat with the flaps hanging downwardly.

In either configuration, the openings for the pockets in the flaps are always oriented upwardly. When in the seat cushion configuration, the filled pockets in the flaps are maintained securely by the fact that the person is sitting on the cushion and will also be maintained when the person rises because of the basic configuration of the cushion and the seat. Another pocket may be provided attached to the cushion to retain a blanket for use on colder days.

BRIEF DESCRIPTION OF THE DRAWING

The objects, advantages and features of this invention will be more readily perceived from the following detailed description, when read in conjunction with the accompanying drawing, in which.

DESCRIPTION OF THE PREFERRED EMBODIMENTS

Figure 1:
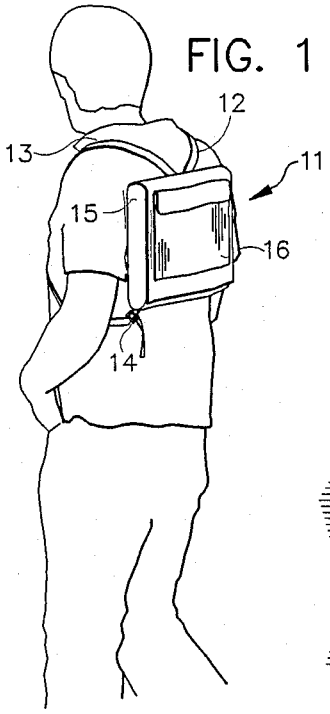
FIG. 1 is a perspective view of the invention in the back pack configuration in place on the back of a person.

With reference now to the drawing and more particularly to FIG. 1 thereof, apparatus 11 is shown in the back pack configuration having straps 12 and 13 which extend from the top portion of the apparatus over the shoulders of the person and down around under the arms to secure to the bottom portion of the apparatus at points 14. In this view, padded portion 15, which functions as the seat cushion, is shown close to the body with flap portion 16 facing rearwardly or outwardly therefrom. It is possible to reverse the apparatus in the back pack configuration so that the flaps 16 face inwardly against the body and the only portion exposed is the padded portion.

Figure 2:
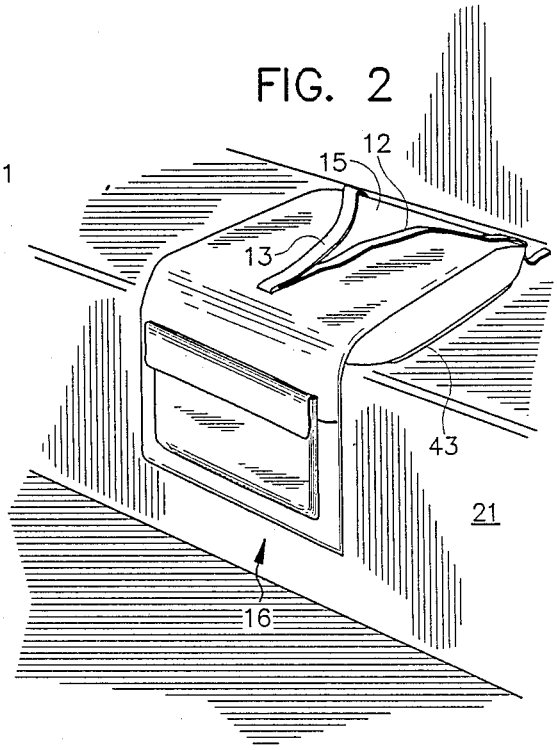
FIG. 2 is a perspective view of the invention in place on a stadium bench.

With reference to FIG. 2 padded portion 15 is shown with straps 12 and 13 on top on which the person would sit. These straps are adjustable and could as easily be positioned under the cushion or along the sides thereof when in the seat cushion configuration. Flaps 16 hang downwardly in front of stadium bench 21, shown here as a concrete seat. It should be appreciated that the invention is just as applicable to individual stadium or arena seats.

Figure 3:
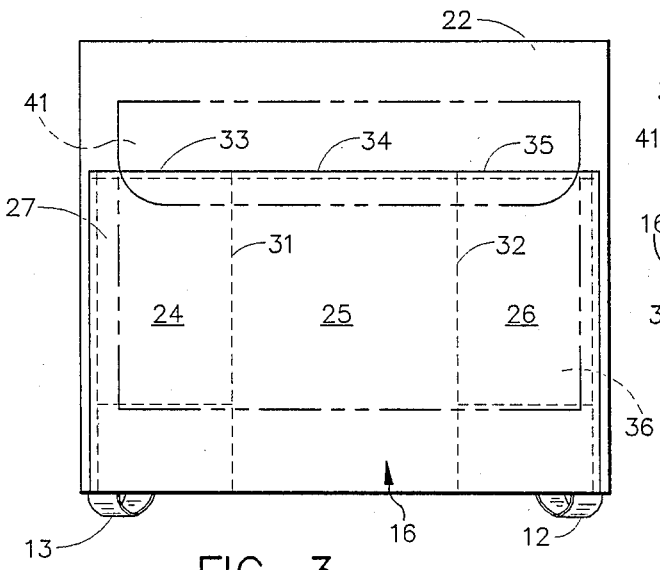
FIG. 3 is a side view of the invention in the back pack configuration.
Figure 4:
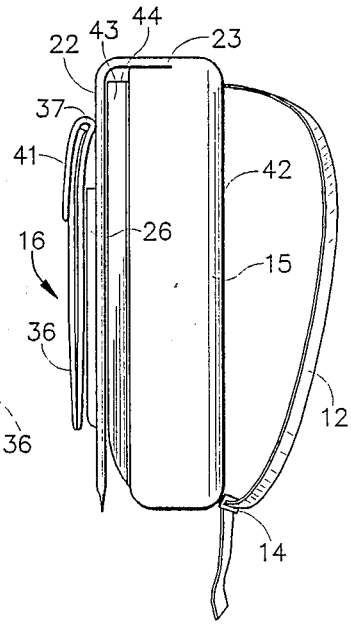
FIG. 4 is an end view of the invention in the back pack configuration.

With reference now to FIGS. 3 and 4 the details of the flap and pocket arrangement will be discussed. Flap 22 is flexibly secured at one end of padded portion 15, for example, at location 23. Flap 22 is formed with pockets 24, 25 and 26 which may either be openings in a two ply flap 22 or comprised of a separate piece of material secured across flap 22. Alternatively, the rearward ply may be folded forward and up the front of the forward ply, from which the pockets are formed. For any of these alternatives, this piece of material is referred to by reference numeral 27. Dashed lines 31 and 32 indicate stitching which forms and separates pockets 24, 25 and 26. Openings 33, 34 and 35 are provided in the top of respective pockets 24, 25 and 26. These pockets may be shaped and configured to selectively contain glasses, suntan lotion, binoculars, cameras, cigarettes or other miscellaneous items. Flap 36, which is shown in phantom FIG. 3 to enable full view of the pockets of flap 16, may be formed with one pocket having an opening 37 at the top thereof. This is a larger pocket and may contain food, a program or any other article which the person may desire. Top flap 41 covers opening 37 of pocket 36.

As stated previously, while the back pack configuration of FIG. 4 shows the strap extending from padded portion 15, these straps are sufficiently flexible and adjustable in length to extend in the other direction from the mountings as shown in FIG. 4 so that the pockets and flaps are against the body of the wearer and side 42 of the padded portion is the only exposed part of the back pack.

As an alternative embodiment, pocket 43 is provided on side 45 of the padded portion and is adapted to contain a blanket. It is also possible that the blanket could be secured to the underside of the padded portion and folded in such a way and secured to itself by such means as a hook and loop fastener that a separate pocket would not be necessary and the blanket would not be separate from the cushion back pack apparatus. Opening 44 is provided for insertion of the blanket in pocket 43 and has an orientation in the same direction as all of the other pockets in flaps 22 and 36.

Note that whether in the back pack or in the seat cushion configuration, the pockets in flaps 22 and 36 have an upward orientation so there is no danger of articles falling out of them. Note also that cover flap 41 visually hides opening 37 and flap 36 visually hides the openings to pockets 24, 25 and 26. While flap 36 is shown somewhat narrower than flap 22, it could be any practical desired width. Likewise, it could be completely contiguous in all dimensions shown with respect to flap 22. In an alternative embodiment, flap 36 may be omitted and cover flap 41 employed to cover and protect pocket openings 33, 34 and 35.

In view of the above description, it is likely that improvements and modifications will occur to those skilled in the art which are within the scope of the appended claims.

What is claimed is:

1. A seat cushion back pack comprising:

a padded portion adapted to be selectively placed on a seat in a cushion configuration and carried in a back pack configuration;

strap means secured to said padded portion for carrying said padded portion on a person's back in the back pack configuration;

first flexible flap means connected to said padded portion, said first flap means being formed with at least one first pocket therein having an opening, said first flap means being folded against said padded portion when in the back pack configuration and hanging downwardly from the seat when in the cushion configuration, with said first opening being oriented upwardly when in either the cushion configuration or the back pack configuration; and second flexible flap means connected to said first flap means, said second flap means being formed with at least one second pocket therein having an opening, said second flap means being folded against said first flap means when in the back pack configuration and hanging downwardly from the seat with said opening therein oriented upwardly when in the cushion configuration;

whereby the contents of said first pockets are readily available to a person when on said cushion, and when the person is so positioned said cushion retains said first flap means and pocket contents securely in place hanging from the seat.

2. The seat cushion back pack recited in claim 1, wherein said second flap means covers the opening to said first pocket in said first flap means.

3. The seat cushion back pack recited in claim 2, wherein said second flap means further comprises a cover flap which flexibly hangs over the opening of said second pocket.

4. The seat cushion back pack recited in claim 1 and further comprising a third pocket connected to said padded portion.

5. The seat cushion back pack recited in claim 4 and further comprising a blanket securely retained in said third pocket.

6. The seat cushion back pack recited in claim 1, wherein said first flap means is formed with a plurality of pockets, all opening upwardly when said padded portion is in either the cushion configuration or the back pack configuration.

7. The seat cushion back pack recited in claim 1, and further comprising a blanket pocket connected to and extending laterally from said padded portion, said blanket pocket being substantially parallel to said padded portion with said padded portion forming one side of said blanket pocket.

8. The seat cushion back pack recited in claim 7 and further comprising a blanket securely retained in said blanket pocket.

9. The seat cushion back pack recited in claim 1, wherein said strap means is adjustable in length and at least one end is releasable from said padded portion.

* * * * *